US007467696B2

(12) United States Patent
Wu

(10) Patent No.: US 7,467,696 B2
(45) Date of Patent: Dec. 23, 2008

(54) GRIP ASSEMBLY FOR LUGGAGE

(75) Inventor: Chen-Chuan Wu, hsin Chuang (TW)

(73) Assignee: Hersun Plastic Co., Ltd., Hsin-Chuang (TW)

( * ) Notice: Subject to any disclaimer, the term of this patent is extended or adjusted under 35 U.S.C. 154(b) by 186 days.

(21) Appl. No.: 11/668,027

(22) Filed: Jan. 29, 2007

(65) Prior Publication Data

US 2008/0179153 A1 Jul. 31, 2008

(51) Int. Cl.
*A45C 13/26* (2006.01)

(52) U.S. Cl. ..... 190/115; 16/113.1

(58) Field of Classification Search ..... 190/115; 16/113.1

See application file for complete search history.

(56) References Cited

U.S. PATENT DOCUMENTS 6,434,790 B1 * 8/2002 Chen ..... 16/113.1
6,892,866 B2 * 5/2005 Wu ..... 190/115
6,978,514 B2 * 12/2005 Kuo et al. ..... 16/113.1
7,191,878 B2 * 3/2007 Lu ..... 190/115
2004/0182666 A1 * 9/2004 Chang et al. ..... 190/115

* cited by examiner

*Primary Examiner*—Tri M Mai
(74) *Attorney, Agent, or Firm*—Ming Chow; Sinorica, LLC

(57) ABSTRACT

A grip assembly includes a base fixedly fastened to a retractable handle for luggage, a lower protective cover shell fastened to the base at the top and having two upright posts, a flexible pad sandwiched between the base and the lower protective cover shell, two grip elements respectively coupled to the upright posts and extending out of two opposite ends of the lower protective cover shell, an upper protective cover shell covered on the lower protective cover shell, a cap capped on the upper protective cover shell, two fastening members respectively fastened to the cap and the upright posts to affix the cap and the upper protective cover shell to the lower protective cover shell and the base, and a spring-supported release mounted in a center through hole of the upper protective cover shell and the center through hole of the cap for operation by the user to unlock the retractable handle.

10 Claims, 3 Drawing Sheets

GRIP ASSEMBLY FOR LUGGAGE

BACKGROUND OF THE INVENTION

1. Field of the Invention

The present invention relates to grips and more particularly, to a grip assembly for luggage handle, which is a combination design that is inexpensive to manufacture.

2. Description of the Related Art

Luis Vuitton is a luxury French fashion brand in Paris, France. Louis Vuitton Malletier à Paris, the founder of the company, designed and manufactured luggage during the second half of the nineteenth century. Louis Vuitton's signature leathergoods are considered a status symbol around the glove and are highly regarded in the fashion world. Nowadays, Louis Vuitton has become the most counterfeited brand in fashion history.

To compete in the market, other luggage manufacturers keep trying hard to crease new designs of parts for luggage. The grip of the retracable handle is one of the impartant parts of a luggage. China Patent 03240757.2 discloses a seamless grip design for luggage entitled "Seamless handle grip of luggage". This design of seamless handle grip is to be mounted on a single pulling rod of luggage, giving an image of high value. Further, this design of seamless handle grip has a strong structural strength. The seamless and smooth flank of the handle grip gives a comfortable touch. However, this seamless handle grip is expensive.

Further, China Patent 03240757.25 discloses a handle grip for luggage, which has the screws mounted in the bottom side of the grip body. This design of handle grip does not give a comfortable touch.

SUMMARY OF THE INVENTION

The present invention has been accomplished under the circumstances in view. It is the main object of the present invention to provide a grip assembly for luggage, which is a combination design formed of multiple parts, having the advantage of low manufacturing cost. It is another object of the present invention to provide a grip assembly for luggage, which is conveniently detachable for easy change of different colors of parts. It is still another object of the present invention to provide a grip assembly for luggage, which uses a flexible pad to absorb shocks, giving comfort to the user pulling the luggage.

To achieve these and other objects of the present invention, the grip assembly for luggage comprises a base fixedly fastened to a top end of a retractable handle for luggage; a lower protective cover shell fastened to a top side of the base; a flexible pad sandwiched between the base and the lower protective cover shell; two upright posts fixedly provided at a top side of the lower protective cover shell; two grip elements mounted on the lower protective cover shell and respectively extending out of two opposite ends of the lower protective cover shell, the grip elements each having a mounting hole respectively coupled to the upright pots; an upper protective cover shell covered on the lower protective cover shell over the grip elements and the upright posts, the upper protective cover shell having two mounting holes respectively coupled to the upright posts and a through hole equally spaced between the two mounting holes of the upper protective cover shell; a cap capped on a top side of the upper protective cover shell, the cap having two mounting holes corresponding to the upright posts and a through hole equally spaced between the two mounting holes of the cap corresponding to the through hole of the upper protective cover shell; two fastening members respectively mounted in the mounting holes of cap and fastened to the upright posts to affix the cap to the upright pots above the upper protective cover shell; and a spring-supported release mounted in the through hole of the upper protective cover shell and the through hole of the cap for operation by the user to unlock the retractable handle.

Because the grip assembly is a combination design formed of multiple parts, it is less expensive when compared to a grip of seamless design. Because the grip assembly is detachable, the user can change the colors of the parts as desired. Further, the cap can be mounted with a logo or any of a variety of designs.

DETAILED DESCRIPTION OF THE PREFERRED EMBODIMENT

Figure 1:
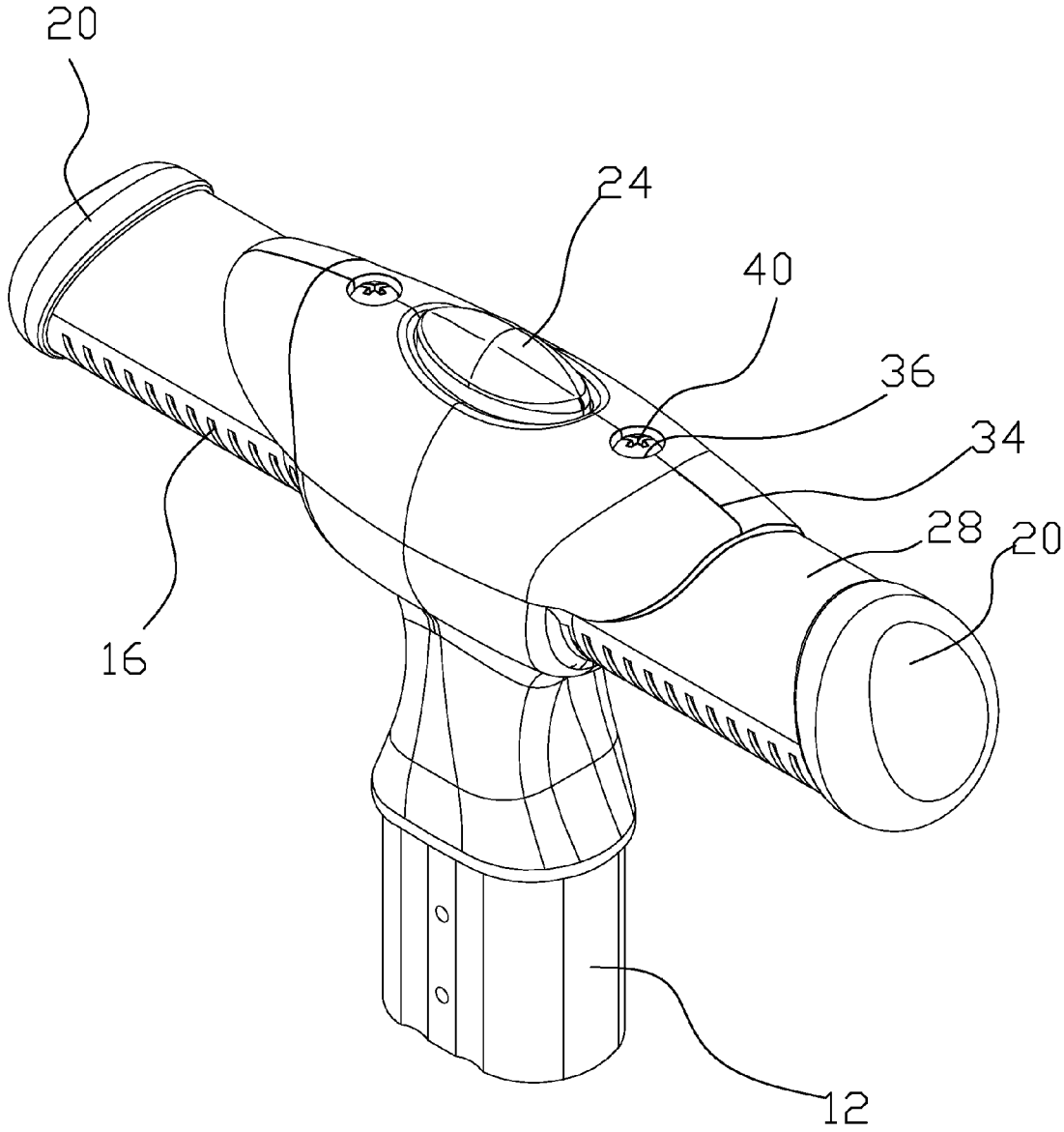
FIG. 1 is an elevational view of a grip assembly according to the present invention.
Figure 2:
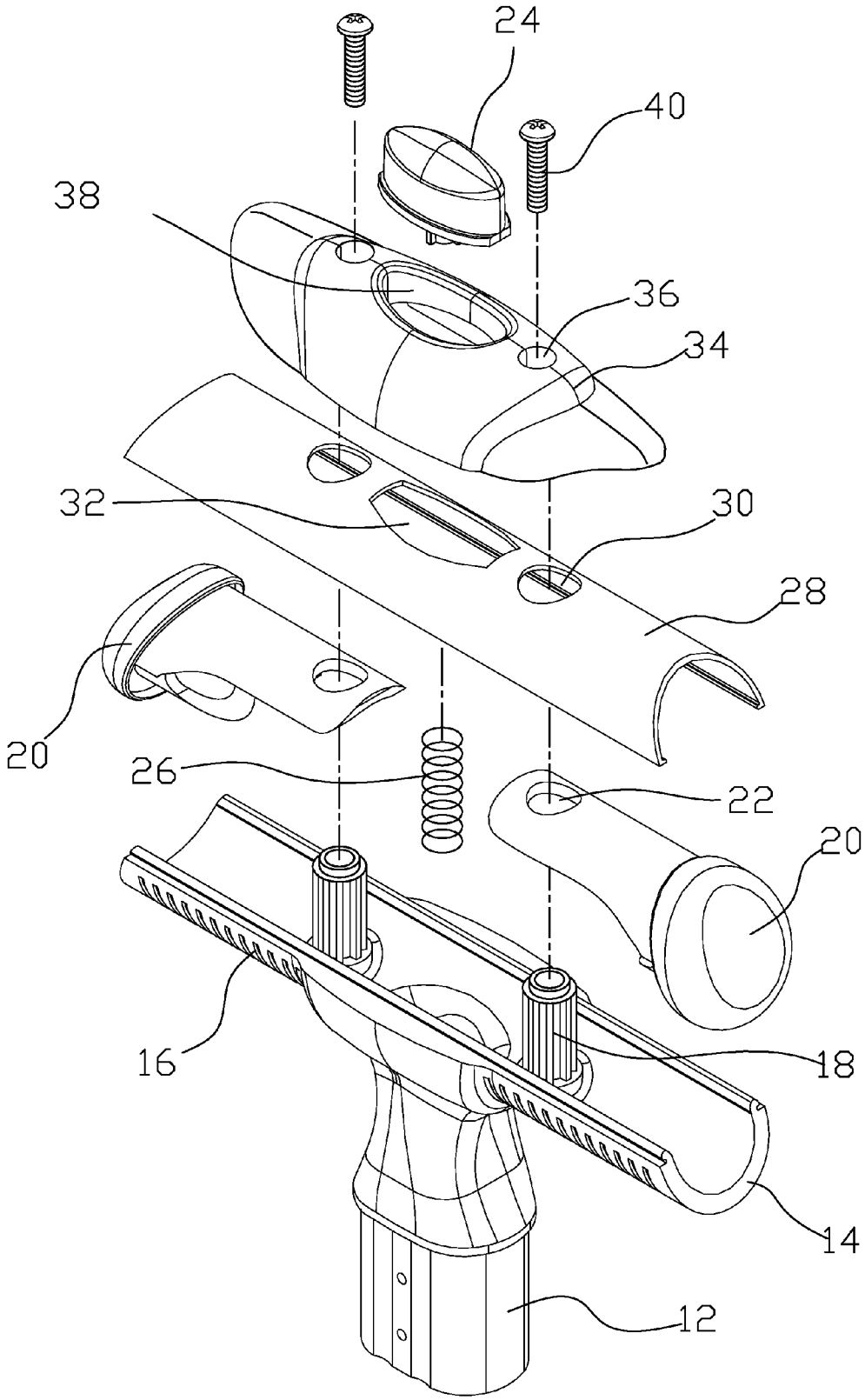
FIG. 2 is an exploded view of the grip assembly according to the present invention.
Figure 3:
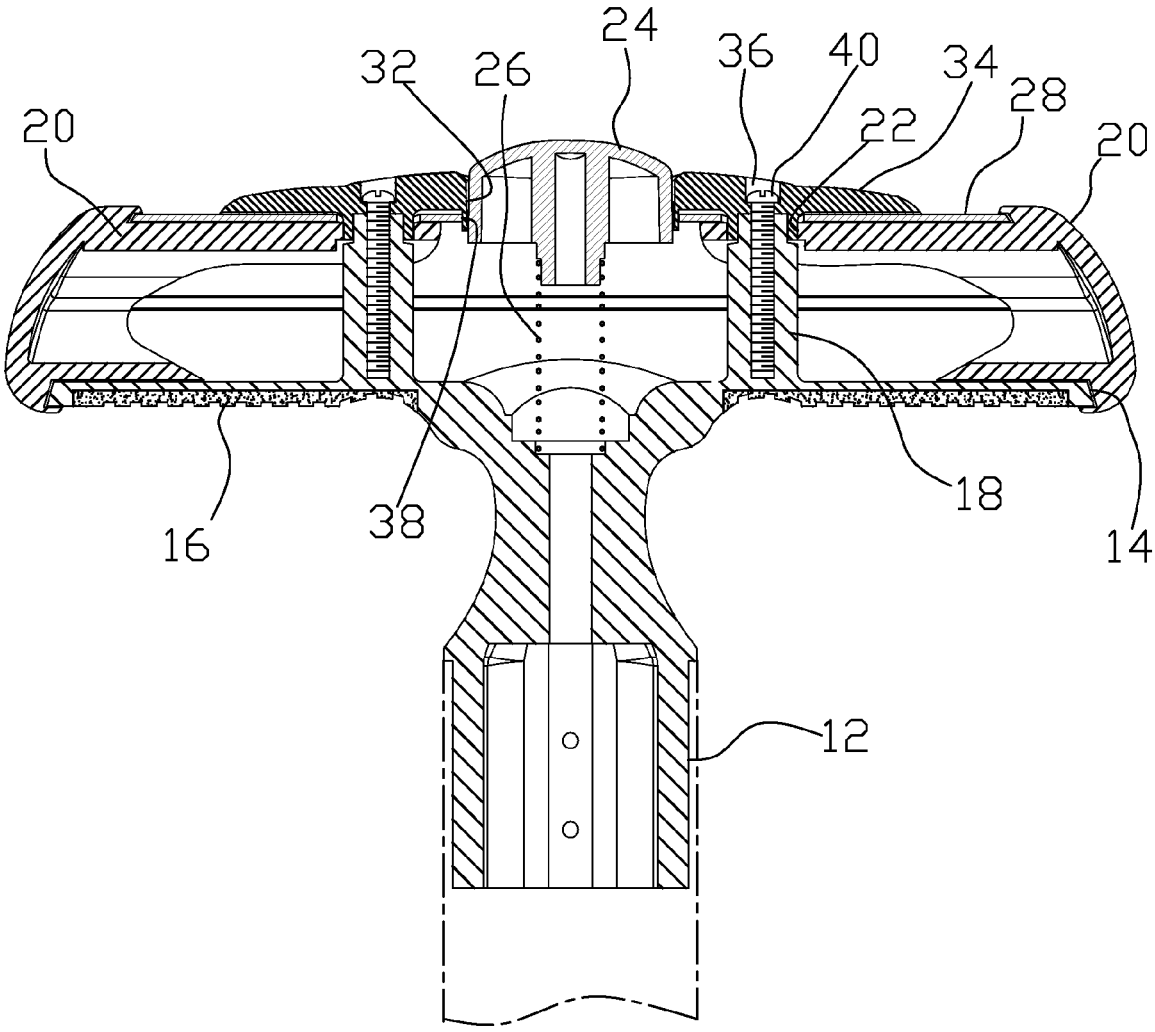
FIG. 3 is a sectional side view of the grip assembly according to the present invention.

Referring to FIGS. 1 and 2, a grip assembly for luggage in accordance with the present invention is shown comprising a base 12 fixedly fastened to the top end of a retractable handle for luggage (not shown). A lower protective cover shell 14 is horizontally provided at the top side of the base 12. The lower protective cover shell 14 is a straight bar having a smoothly arched cross section. A flexible pad 16 is sandwiched between the base 12 and the lower protective cover shell 14. The flexible pad 16 can be made out of an elastic foam material, polyester fiber, silicon rubber, or rubber. The flexible pad 16 absorbs shocks when the user is pulling the luggage on the floor. Further, the lower protective cover shell 14 has two hollow posts 18 perpendicularly upwardly extended from the top side. The hollow posts 18 are polygonal rod members, each having a stepped top end, i.e., each hollow post 18 has a reduced top end. Further, each hollow post 18 defined therein screw hole or pin hole.

Two grip elements 20 are respectively attached to the top side of the lower protective cover shell 14 and respectively extended out of the two distal ends of the lower protective cover shell 14, each having a mounting hole 22 respectively coupled to the hollow posts 18. The mounting hole 22 fits the contour of the associating hollow post 18. A release comprised of a button 24 and a spring 26 is provided between the hollow pasts 18. The spring 26 has one end stopped at the base 12, and the other end connected to the bottom side of the button 24. Pressing the button 24 after the retractable handle of the luggage has been set in the extended position will unlock the retractable handle, for enabling the user to move the grip assembly and the retractable handle between the extended position and the received position.

Further, an upper protective cover shell 28 is covered on the lower protective cover shell 14. The upper protective cover shell 28 has two mounting holes 30 respectively coupled to the hollow posts 18, and a through hole 32 equally spaced between the two mounting holes 30 for the passing of the spring 26 and the button 24. The mounting holes 30 fit the contour of the hollow posts 18 respectively. The upper protective cover shell 28 and the lower protective cover shell 14 define a space that accommodates the grip elements 20.

Further, a cap 34 is capped on the top side of the upper protective cover shell 28. The cap 34 fits over the smoothly arched outer surface of the upper protective cover shell 28. The cap 34 may be molded from acrylic or plastics, or made out of aluminum, iron, or any of a variety of metal alloys. Further, the cap 34 has two mounting holes, for example, screw holes 36 respectively fastened to the hollow posts 18 with a respective fastening member, for example, screw 40, and a through hole 38 spaced between the screw holes 36 for accommodating the button 24. Further, the screw hole 36 fits the stepped top end of the associating hollow post 18.

The grip assembly of the present invention is a detachable combination design that is less expensive when compared to a seamless tube structure design. Further, the grip assembly of the present invention is conveniently detachable. The invention allows change of different colors of grip elements 20 and cap 34 conveniently. Further, the cap 34 may be provided with a design, for example, the logo of the manufacturer. Further, the top mounting of the fastening members 40 allows quick dismounting of the grip assembly for a replacement of either part, for example, the cap 34, the grip elements 20, the upper protective cover shell 28, or the button 24. Further, the flexible pad 16 enhances the comfort use of the grip assembly.

Although a particular embodiment of the invention has been described in detail for purposes of illustration, various modifications and enhancements may be made without departing from the spirit and scope of the invention.

What the invention claimed is:

1. A grip assembly comprising:

a base fixedly fastened to a top end of a retractable handle for luggage;

a lower protective cover shell fastened to a top side of said base;

a flexible pad sandwiched between said base and said lower protective cover shell;

two upright posts fixedly provided at a top side of said lower protective cover shell;

two grip elements mounted on said lower protective cover shell and respectively extending out of two opposite ends of said lower protective cover shell, said grip elements each having a mounting hole respectively coupled to said upright pots;

an upper protective cover shell covered on said lower protective cover shell over said grip elements and said upright posts, said upper protective cover shell having two mounting holes respectively coupled to said upright posts and a through hole equally spaced between the two mounting holes of said upper protective cover shell;

a cap capped on a top side of said upper protective cover shell, said cap having two mounting holes corresponding to said upright posts and a through hole equally spaced between the two mounting holes of said cap corresponding to the through hole of said upper protective cover shell;

two fastening members respectively mounted in the mounting holes of cap and fastened to said upright posts to affix said cap to said upright pots above said upper protective cover shell; and a spring-supported release mounted in the through hole of said upper protective cover shell and the through hole of said cap for operation by a user to unlock said retractable handle.

2. The grip assembly as claimed in claim 1, wherein said cap is made out of one of materials including acrylic, plastics, aluminum, iron, and their metal alloys.

3. The grip assembly as claimed in claim 1, wherein said flexible pad is made out of one of materials including elastic foam materials, polyester fiber, silicon rubber, and rubber.

4. The grip assembly as claimed in claim 1, wherein said fastening members are screws; said upright posts each define therein a vertical screw hole for mounting of said screws.

5. The grip assembly as claimed in claim 1, wherein said fastening members are pins; said upright post each define therein a vertical pin hole for mounting of said pins.

6. The grip assembly as claimed in claim 1, wherein said spring-supported release comprises a spring member supported on said base, and a button supported on said spring member and received in the through hole of said upper protective cover shell and the through hole of said cap.

7. The grip assembly as claimed in claim 1, wherein said upright posts are polygonal rod members each having a stepped top end.

8. The grip assembly as claimed in claim 1, wherein the mounting holes of said grip elements fit contour of said upright posts respectively.

9. The grip assembly as claimed in claim 1, wherein the mounting holes of said upper protective cover shell fit contour of said upright posts respectively.

10. The grip assembly as claimed in claim 1, wherein the mounting holes of said cap are screw holes fitting stepped top ends of said upright posts respectively.

* * * * *